US011204577B1

(12) United States Patent
Ogasawara et al.

(10) Patent No.: US 11,204,577 B1
(45) Date of Patent: Dec. 21, 2021

(54) IMAGE FORMING APPARATUS AND CONTROL METHOD THEREOF

(71) Applicant: TOSHIBA TEC KABUSHIKI KAISHA, Tokyo (JP)

(72) Inventors: Masato Ogasawara, Tokyo (JP); Tatsuya Kitajima, Kawasaki Kanagawa (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/023,703

(22) Filed: Sep. 17, 2020

(51) Int. Cl.
*G03G 21/00* (2006.01)
*G03G 15/00* (2006.01)
*G03G 15/08* (2006.01)

(52) U.S. Cl.
CPC ..... *G03G 21/0005* (2013.01); *G03G 15/5008* (2013.01); *G03G 15/0815* (2013.01); *G03G 21/0058* (2013.01); *G03G 2221/0005* (2013.01)

(58) Field of Classification Search
CPC ..... G03G 15/5008; G03G 15/0815; G03G 21/0005; G03G 21/0058; G03G 2221/0005
See application file for complete search history.

(56) References Cited

U.S. PATENT DOCUMENTS 7,609,986 B2 * 10/2009 Sanmonji ..... G03G 15/5008 399/34
7,738,807 B2 6/2010 Inada et al.
2002/0034401 A1 * 3/2002 Yanagida ..... G03G 15/5008 399/167

* cited by examiner

*Primary Examiner* — Joseph S Wong
(74) *Attorney, Agent, or Firm* — Amin, Turocy & Watson, LLP

(57) ABSTRACT

According to one embodiment, an image forming apparatus includes an image carrier, a cleaning member, a determination unit, and a control unit. The image carrier carries a developer image. The cleaning member removes a developer adhering to a surface of the image carrier by a frictional force when the image carrier is rotated in a first direction. The determination unit determines an image forming amount in a plurality of continuous image forming jobs. The control unit rotates the image carrier in the first direction during the image forming period and in a second direction opposite to the first direction at reverse rotation timing, and changes a condition for rotation in the second direction according to the determination result.

14 Claims, 9 Drawing Sheets

FIG. 4

| | | INTERMITTENCE RATE ZONE | | | |
|---|---|---|---|---|---|
| | | IRA | IRB | IRC | IRD |
| TEMPERATURE ZONE | TZA | SAA | SAB | SAC | SAD |
| | TZB | SBA | SBB | SBC | SBD |
| | TZC | SCA | SCB | SCC | SCD |
| | TZD | SDA | SDB | SDC | SDD |
| | TZE | SEA | SEB | SEC | SED |

| | | INTERMITTENCE RATE ZONE | | | |
|---|---|---|---|---|---|
| | | IRA | IRB | IRC | IRD |
| TEMPERATURE ZONE | TZA | QAA | QAB | QAC | QAD |
| | TZB | QBA | QBB | QBC | QBD |
| | TZC | QCA | QCB | QCC | QCD |
| | TZD | QDA | QDB | QDC | QDD |
| | TZE | QEA | QEB | QEC | QED |

IMAGE FORMING APPARATUS AND CONTROL METHOD THEREOF

FIELD

Embodiments described herein relate generally to an image forming apparatus and a control method thereof.

BACKGROUND

An electrophotographic image forming apparatus uses a cleaning blade that is in contact with or close to a surface of a photoreceptor to scrape off a developer remaining on the surface of the photoreceptor.

The photoreceptor is rotated in a fixed direction during image formation. Therefore, if the image formation is continued, substances such as wax and paper dust contained in the developer adhere to a tip of the cleaning blade, which may deteriorate the cleaning performance.

Therefore, there is known a technique for removing the substance from the tip of the cleaning blade by rotating the photoreceptor in the reverse direction at a fixed cycle when the image formation is not being performed.

However, since the image cannot be formed during the reverse rotation of the photoreceptor, if the frequency of the reverse rotation is increased, the ratio of the image non-formable period to the image formable period increases and thus, the productivity is decreased. Therefore, if the frequency of the reverse rotation is reduced, there is a concern that the deterioration of the cleaning performance due to the adhesion of the substance to the tip of the cleaning blade cannot be prevented.

Under these circumstances, it has been desired to prevent deterioration of the cleaning performance while suppressing a decrease in productivity.

DESCRIPTION OF THE DRAWINGS

FIG. 4 is a diagram showing an example of a threshold table shown in FIG. 3;

DETAILED DESCRIPTION

In general, according to one embodiment, the image forming apparatus includes an image carrier, a cleaning member, a determination unit, and a control unit. The image carrier carries a developer image. The cleaning member removes a developer adhering to a surface of the image carrier by a frictional force when the image carrier is rotated in a first direction. The determination unit determines an image forming amount in a plurality of continuous image forming jobs. The control unit rotates the image carrier in the first direction during the image forming period and in a second direction opposite to the first direction at reverse rotation timing, and changes a condition for rotation in the second direction according to the determination result.

Hereinafter, some embodiments will be described with reference to the drawings. In each embodiment, a multi-function peripheral (MFP) equipped with an image forming apparatus as a printer will be described as an example. The contents of various operations and various processes described below are examples and changes in the order of some operations and processes, omission of some operations and processes, or addition of other operations and processes is possible as appropriate.

First, a common configuration of the MFP according to each embodiment will be described.

Figure 1:
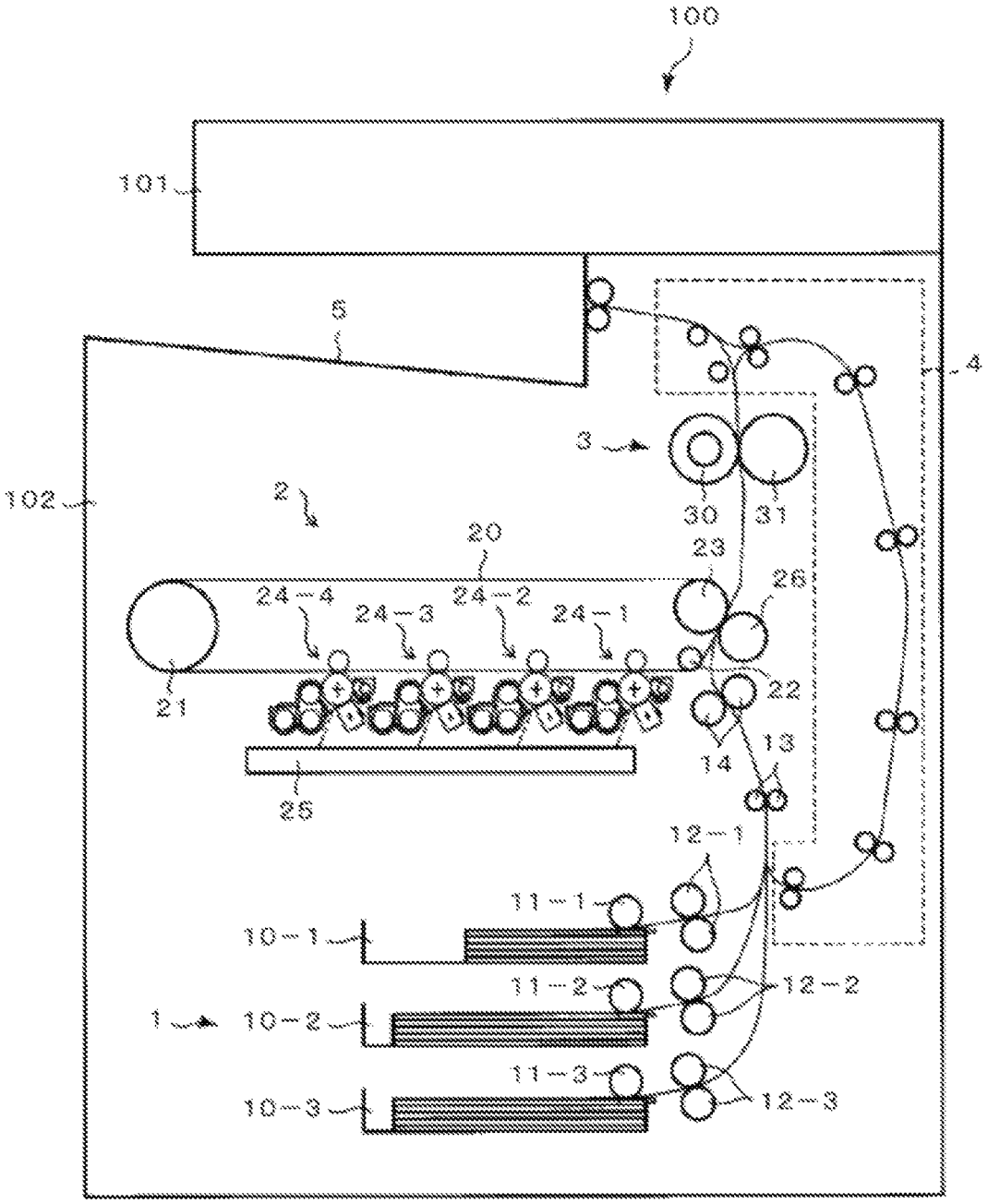
FIG. 1 is a diagram schematically showing a mechanical configuration of an MFP according to an embodiment.

FIG. 1 is a diagram schematically showing a mechanical configuration of an MFP 100 according to each embodiment.

As shown in FIG. 1, the MFP 100 includes a scanner 101 and a printer 102.

The scanner 101 reads an image of a document and generates image data corresponding to the image. The scanner 101 uses an image sensor such as a CCD line sensor to generate image data according to a reflected light image from the reading surface of the document. The scanner 101 scans a document placed on a document table with an image sensor that moves along the document. Alternatively, the scanner 101 scans a document conveyed by an auto document feeder (ADF) with a fixed image sensor.

The printer 102 forms an image on an image forming medium by the electrophotographic method. The medium is typically a print sheet such as cut paper. Therefore, in the following description, it is assumed that a print sheet is used as the medium. However, as the medium, a sheet material made of paper other than the cut paper may be used or a sheet material made of a material other than paper, such as resin, may be used. The printer 102 has a color printing function of printing a color image on a print sheet and a monochrome printing function of printing a monochrome image on the print sheet. The printer 102 forms a color image by superposing element images respectively using, for example, three colors of developers of yellow, cyan and magenta, or four colors including black added thereto. In addition, the printer 102 forms a monochrome image using, for example, a black developer. However, the printer 102 may have only one of the color printing function and the monochrome printing function.

In the configuration example shown in FIG. 1, the printer 102 includes a sheet feeding unit 1, a print engine 2, a fixing unit 3, an automatic double-sided unit (ADU) 4, and a paper discharge tray 5.

The sheet feeding unit 1 includes sheet feed cassettes 10-1, 10-2, and 10-3, pickup rollers 11-1, 11-2, and 11-3, conveying rollers 12-1, 12-2, and 12-3, a conveying roller 13, and a registration roller 14.

The sheet feed cassettes 10-1, 10-2, and 10-3 store print sheets in a stacked state. The print sheet stored in each of the sheet feed cassettes 10-1, 10-2, and 10-3 may be another kind of print sheet having a different size and material, or the same kind of print sheet. The sheet feeding unit 1 may also include a manual feed tray.

The pickup rollers 11-1, 11-2, and 11-3 pick up the print sheets one by one from the respective sheet feed cassettes 10-1, 10-2, and 10-3. The pickup rollers 11-1, 11-2, and 11-3 convey the picked-up print sheet to the conveying rollers 12-1, 12-2, and 12-3.

The conveying rollers 12-1, 12-2, and 12-3 convey the print sheet conveyed from the pickup rollers 11-1, 11-2, and 11-3 to the conveying roller 13 through a conveyance path formed by a guide member (not shown) or the like.

The conveying roller 13 further conveys the print sheet conveyed from any of the conveying rollers 12-1, 12-2, and 12-3 to the registration roller 14.

The registration roller 14 corrects the inclination of the print sheet. The registration roller 14 adjusts the timing of conveying the print sheet to the print engine 2.

The sheet feed cassette, the pickup roller, and the conveying roller are not limited to three sets and any number of sets may be provided. Further, if the manual feed tray is provided, it is not necessary to provide a set of the sheet feed cassette and a pair of pickup roller and conveying roller which are paired with the sheet feed cassette.

The print engine 2 includes a belt 20, support rollers 21, 22, and 23, image forming units 24-1, 24-2, 24-3, and 24-4, an exposure unit 25, and a transfer roller 26.

The belt 20 has an endless shape and is supported by the support rollers 21, 22, and 23 so as to maintain the state shown in FIG. 1. The belt 20 rotates counterclockwise in FIG. 1 as the support roller 21 rotates. The belt 20 temporarily carries an image to be formed on the print sheet.

The image forming units 24-1, 24-2, 24-3, and 24-4 each include a photoreceptor, a charger, a Photosensitive layer, a transfer roller, and a cleaner, and has a well-known structure for performing image formation by the electrophotographic method in cooperation with the exposure unit 25. The image forming units 24-1, 24-2, 24-3, and 24-4 are arranged along the belt 20 in a state where the axial directions of the respective photoreceptors are parallel to each other. The image forming units 24-1, 24-2, 24-3, and 24-4 have the same structure and operation with a difference only in the colors of the developers used. The image forming unit 24-1 forms an element image using, for example, a black developer. The image forming unit 24-2 forms an element image using, for example, a magenta developer. The image forming unit 24-3 forms an element image using, for example, a cyan developer. The image forming unit 24-4 forms an element image using, for example, a yellow developer. The image forming units 24-1, 24-2, 24-3, and 24-4 make the element images of respective colors overlap each other on the belt 20. As a result, the image forming units 24-1, 24-2, 24-3, and 24-4 form a color image in which each element image of each color is superimposed on the belt at the time when the image forming unit 24-1 passed.

The exposure unit 25 includes four built-in exposure units respectively associated with the image forming units 24-1, 24-2, 24-3, and 24-4. The exposure unit 25 exposes the photoreceptors of the image forming units 24-1, 24-2, 24-3, and 24-4 according to image data representing element images of respective colors. A laser scanner, a light emitting diode (LED) head, or the like is used as the exposure device.

The transfer roller 26 is arranged in parallel with the support roller 23 and sandwiches the belt 20 between the transfer roller 26 and the support roller 23. The transfer roller 26 sandwiches the print sheet conveyed from the registration roller 14 between the transfer roller 26 and the belt 20. Then, the transfer roller 26 transfers the image formed on the belt 20 onto a print sheet by using the electrostatic force.

Thus, the print engine 2 forms an image on the print sheet conveyed by the registration rollers 14 by the electrophotographic method.

The fixing unit 3 includes a fixing roller 30 and a pressure roller 31.

The fixing roller 30 houses a heater inside a hollow roller made of, for example, heat-resistant resin. The heater is, for example, an induction heating (IH) heater but any other type of heater can be used as appropriate. The fixing roller 30 fixes the developer on the print sheet by melting the developer attached to the print sheet conveyed from the print engine 2.

The pressure roller 31 is provided in parallel with the fixing roller 30 and pressed against the fixing roller 30. The pressure roller 31 sandwiches the print sheet conveyed from the print engine 2 between the pressure roller 31 and the fixing roller 30 and presses the print sheet against the fixing roller 30.

An ADU 4 includes a plurality of rollers and selectively performs the following two operations. In a first operation, the print sheet that passed through the fixing unit 3 is directly conveyed to the sheet discharge tray 5. The first operation is performed when single-sided printing or double-sided printing is completed. In a second operation, the print sheet that passed through the fixing unit 3 is once conveyed to the sheet discharge tray 5 side and then switched back to be conveyed to the print engine 2. The second operation is performed when the image formation on only one side in double-sided printing is completed.

The sheet discharge tray 5 receives the print sheet discharged with an image formed thereon.

Figure 2:
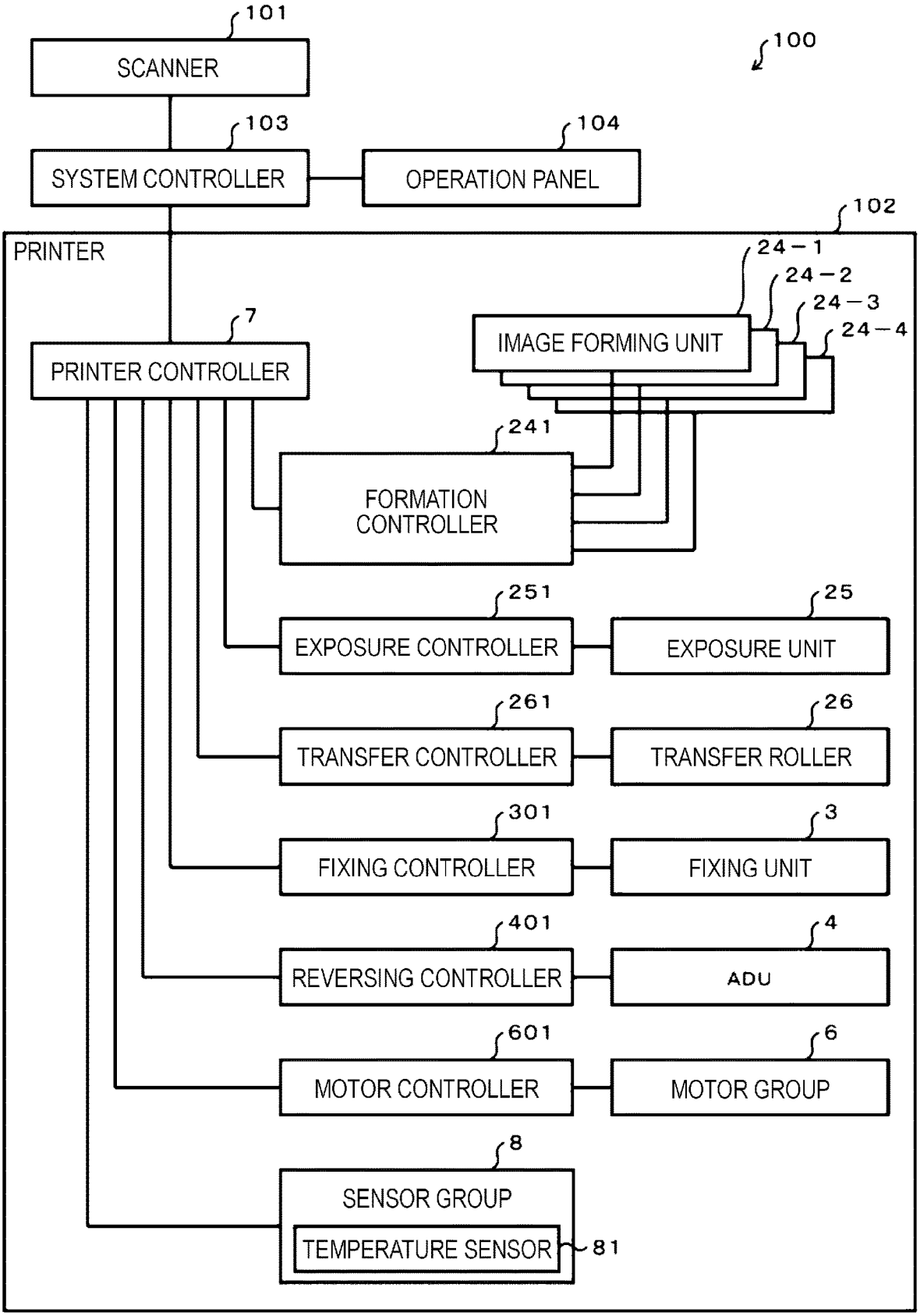
FIG. 2 is a block diagram schematically showing a configuration related to the control of the MFP shown in FIG. 1.

FIG. 2 is a block diagram schematically showing a configuration related to the control of the MFP 100. In FIG. 2, the same elements as those shown in FIG. 1 are denoted by the same reference numerals and the detailed descriptions thereof will be omitted.

The MFP 100 includes a system controller 103 and an operation panel 104 in addition to the scanner 101 and the printer 102.

The system controller 103 centrally controls each unit included in the MFP 100 in order to realize the intended operation of the MFP 100. The intended operation of the MFP 100 is, for example, an operation for realizing various functions realized by an existing MFP.

The operation panel 104 includes an input device and a display device. The operation panel 104 inputs an instruction from an operator using an input device. The operation panel 104 uses a display device to display various kinds of information to be notified to the operator. A touch panel, for example, can be used as the operation panel 104.

The above-mentioned fixing unit 3, ADU 4, image forming units 24-1, 24-2, 24-3, and 24-4, exposure unit 25, and transfer roller 26 included in the printer 102 are elements to be controlled. In addition to these, the printer 102 includes a motor group 6 as an element to be controlled. The motor group 6 includes a plurality of motors for rotating the pickup rollers 11-1, 11-2, and 11-3, the conveying rollers 12-1, 12-2, and 12-3, the conveying roller 13, the registration roller 14, the support roller 21, the transfer roller 26, the fixing roller 30, and the rollers included in the ADU 4.

The printer 102 further includes a printer controller 7, a sensor group 8, a fixing controller 301, a reversing controller 401, a motor controller 601, a formation controller 241, an exposure controller 251, and a transfer controller 261.

The fixing controller 301, the reversing controller 401, the motor controller 601, the formation controller 241, the exposure controller 251, and the transfer controller 261 all operate under the control of the printer controller 7 and control the operations of the ADU 4, the motor group 6, and the image forming units 24-1 to 24-4, the exposure unit 25 and the transfer roller 26, respectively.

Under the control of the system controller 103, the printer controller 7 centrally controls each unit included in the printer 102 in order to realize the intended operation of the printer 102.

The sensor group 8 includes various sensors for monitoring the operating state of the device. One of the sensors included in the sensor group 8 is a temperature sensor 81. The temperature sensor 81 measures the temperature inside the MFP 100.

First Embodiment

Figure 3:
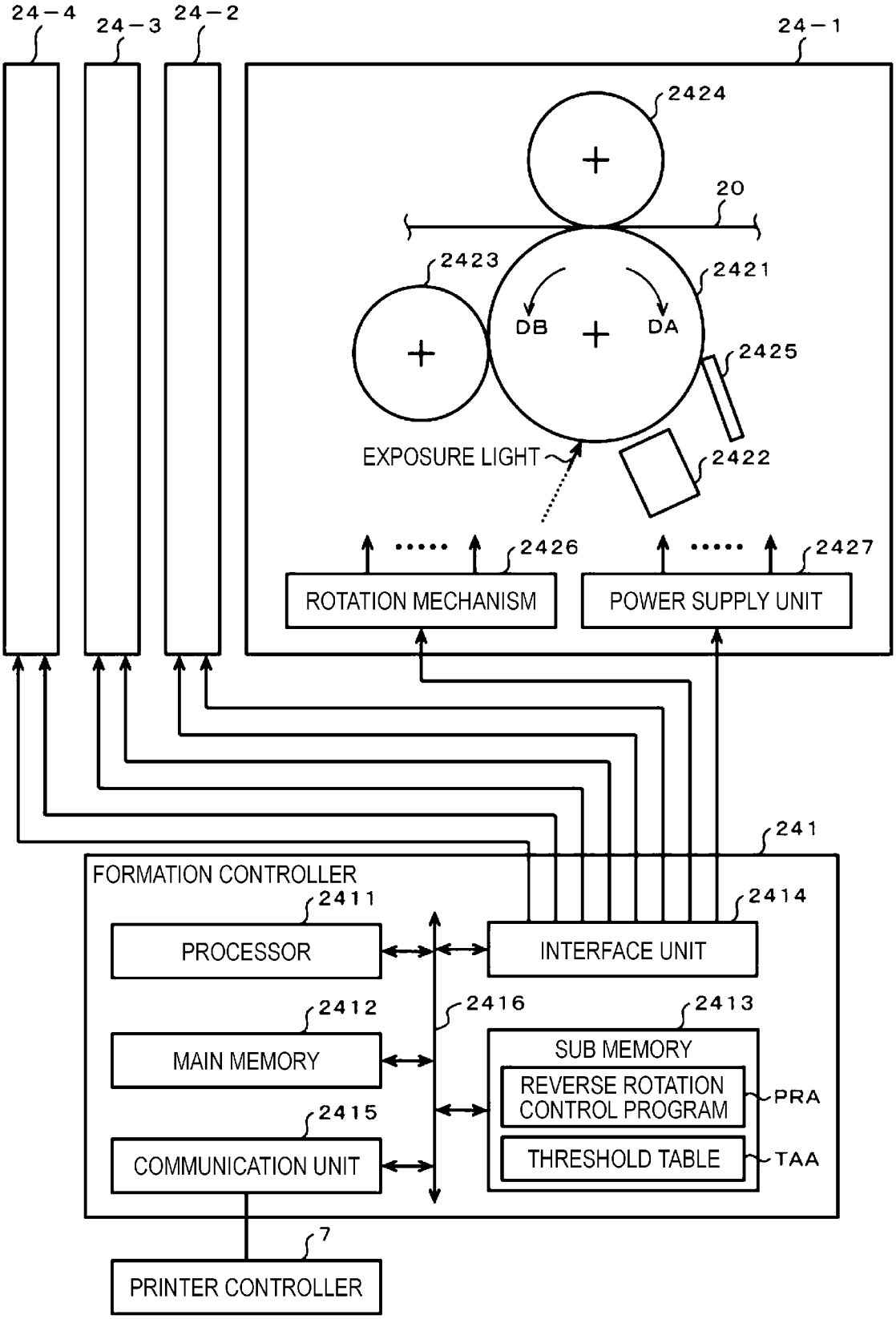
FIG. 3 is a diagram showing a circuit configuration of a main part of a formation controller shown in FIG. 2 according to a first embodiment and a partial configuration of an image forming unit shown in FIG. 2.

FIG. 3 is a diagram showing a circuit configuration of a main part of the formation controller 241 according to a first embodiment and a partial configuration of the image forming unit 24-1.

Since the image forming units 24-1 to 24-4 have the same configuration, only the configuration of the image forming unit 24-1 is shown in FIG. 3, and the illustrations and descriptions of configurations of the developing devices 242-2 to 242-4 included in the image forming units 24-2 to 24-4 will be omitted.

The image forming unit 24-1 includes a photoreceptor 2421, a charger 2422, a developing sleeve 2423, a transfer roller 2424, a cleaning blade 2425, a rotation mechanism 2426, and a power supply unit 2427.

The photoreceptor 2421 is configured by forming a photosensitive layer by coating a photosensitive conductive material on a curved surface of a base material formed by forming a conductor such as aluminum in a cylindrical shape. In the following, the curved surface of the photoreceptor 2421 will be referred to as a photosensitive surface. The photoreceptor 2421 is rotatably supported by the housing of the image forming unit 24-1 in a posture in which the axial direction is oriented in a depth direction in FIG. 3.

The charger 2422 uniformly charges the photosensitive surface of the photoreceptor 2421 to a predetermined potential.

The developing sleeve 2423 is an element of the developing device. The developing sleeve 2423 has a columnar shape and is rotatably supported by the housing of the developing device in a posture in which the axial direction is oriented in the depth direction in FIG. 3. A part of the curved surface of the developing sleeve 2423 is located in the storage space formed inside the housing, and another part of the curved surface is located outside the housing. The portion of the curved surface of the developing sleeve 2423 located outside the housing is close to the photosensitive surface of the photoreceptor 2421. The storage space is a space for containing unused developer.

The transfer roller 2424 is an element of the transfer device. The transfer roller 2424 has a columnar shape and is rotatably supported by the housing of the transfer device in a posture in which the axial direction is oriented in the depth direction in FIG. 3. The transfer roller 2424 faces the photoreceptor 2421 and sandwiches the belt 20 with the photosensitive surface of the photoreceptor 2421.

The cleaning blade 2425 is an element of the cleaner. The cleaning blade 2425 has a plate-like shape and is attached to a storage container of the cleaner with its tip in contact with or close to the photosensitive surface of the photoreceptor 2421. The cleaning blade 2425 scrapes off the developer remaining on the surface of the photoreceptor 2421 into a storage container.

The rotation mechanism 2426 includes, for example, a motor and a gear and rotates the photoreceptor 2421 and the developing sleeve 2423, respectively. The rotation mechanism 2426 can rotate the photoreceptor 2421 in both a direction DA and a direction DB.

The power supply unit 2427 supplies electric power to the charger 2422, the developing sleeve 2423, and the like.

The formation controller 241 includes a processor 2411, a main memory 2412, a sub memory 2413, an interface unit 2414, a communication unit 2415, and a transmission path 2416. The processor 2411, the main memory 2412, the sub memory 2413, the interface unit 2414, and the communication unit 2415 are communicable via the transmission path 2416. The processor 2411, the main memory 2412, and the sub memory 2413 are connected by the transmission path 2416, thereby configuring a computer for controlling the image forming units 24-1 to 24-4.

The processor 2411 corresponds to the central part of the computer. The processor 2411 executes information processing for controlling the image forming units 24-1 to 24-4 according to an information processing program. The processor 2411 is, for example, a central processing unit (CPU).

The main memory 2412 corresponds to the main storage part of the computer. The main memory 2412 temporarily stores the above information processing program read from the sub memory 2413. The main memory 2412 stores data necessary for the processor 2411 to execute information processing. The main memory 2412 is used as a work area in which data is appropriately rewritten by the processor 2411. The main memory 2412 is, for example, a random access memory (RAM).

The sub memory 2413 corresponds to the auxiliary storage part of the computer. The sub memory 2413 is, for example, an electric erasable programmable read-only memory (EEPROM). The sub memory 2413 stores the above information processing program. One of the information processing programs stored in the sub memory 2413 is a reverse rotation control program PRA which describes reverse rotation control processing described later. A part of the storage area of the sub memory 2413 is used to store the threshold table TAA.

The interface unit 2414 is connected to the rotation mechanism 2426 and the power supply unit 2427 provided in each of the developing devices 242-1 to 242-4. The interface unit 2414 outputs a control signal for controlling the rotation mechanism 2426 and the power supply unit 2427 under the control of the processor 2411.

The communication unit 2415 executes communication processing for exchanging various data with the printer controller 7.

The transmission path 2416 includes an address bus, a data bus, a control signal line, and the like, and transmits data and control signals exchanged between the connected parts.

FIG. 4 is a diagram showing an example of a threshold table TAA.

The threshold table TAA is a data table in which thresholds for determining whether or not to execute a reverse rotation operation described later are described. The threshold represents the number of formed sheets which defines the start timing of the reverse rotation operation. In the present embodiment, the thresholds are set in association with the combinations of five temperature zones TZA, TZB, TZC, TZD, and TZE, and four intermittence rate zones IRA, IRB, IRC, and IRD. The temperatures included in each temperature zone have a relationship of TZA>TZB>TZC>TZD>TZE. Specifically, for example, the temperature zone TZA is set to "45° C. or higher" and the temperature zone TZB is set to "40° C. or higher and lower than 45° C.". The intermittence rates included in each intermittence rate zone have a relationship of IRA<IRB<IRC<IRD. Specifically, for example, the intermittence rate zone IRA is set to "less than 20", and the intermittence rate zone IRB is set to "20 or more and less than 40". The intermittence rate is an average value of the number of sheets formed in a plurality of predetermined jobs among the completed image forming jobs (hereinafter, simply referred to as jobs). In the present embodiment, the intermittence rate is obtained as a moving average of the number of formed sheets for each of the latest 10 jobs.

Each threshold has a relationship of SAA>SAB>SAC>SAD, SBA>SBB>SBC>SBD, SCA>SCB>SCC>SCD, SDA>SDB>SDC>SDD, and SEA>SEB>SEC>SED. That is, the threshold associated with the same temperature zone has a smaller value as the associated intermittence rate zone is larger. Specifically, for example, the threshold SAA is set to "40" and the threshold SAB is set to "35".

Each threshold has a relationship of SAA<SBA<SCA<SDA<SEA, SAB<SBB<SCB<SDB<SEB, SAC<SBC<SCC<SDC<SEC, and SAD<SBD<SCD<SDD<SED. That is, the threshold associated with the same intermittence rate zone has a smaller value as the associated temperature zone is higher. Specifically, for example, the threshold SAA is set to "40" and the threshold SBA is set to "80".

The specific value of each threshold changes depending on the properties of the developer used. Therefore, the threshold table TAA is appropriately set by, for example, the designer of the MFP 100 based on experiments, simulations, empirical rules, and the like.

Next, the operation of the MFP 100 configured as above will be described. In the following, operations different from those of another existing MFP will be mainly described and the descriptions of other operations will be omitted.

First, an image forming operation in the image forming unit 24-1 will be described although the image forming operation is similar to that of another existing MFP. The operations of the image forming units 24-2 to 24-4 are the same as that of the image forming unit 24-1 and therefore, the descriptions thereof will be omitted.

During image formation, the processor 2411 rotates the photoreceptor 2421 in the direction DA by the rotation mechanism 2426. Further, the processor 2411 causes the power supply unit 2427 to supply the charger 2422 with electric power for charging with the charging amount for image formation. By this power supply, the charger 2422 uniformly charges the photosensitive surface of the photoreceptor 2421 to a state suitable for forming an electrostatic latent image.

The exposure light emitted from the exposure unit 25 to the image forming unit 24-1 is incident on the charged photosensitive surface of the photoreceptor 2421. The conductivity of the photosensitive layer of the photoreceptor 2421 is improved upon exposure. As a result, the charge in the region where the exposure light is incident is removed and an electrostatic latent image is formed on the photosensitive surface according to the exposure.

The processor 2411 rotates the developing sleeve 2423 by the rotation mechanism 2426. To the curved surface of the developing sleeve 2423, the developer contained in the storage space inside the housing of the developing device adheres. The developer adhering to the curved surface of the developing sleeve 2423 is conveyed to the outside of the housing of the developing device as the developing sleeve 2423 rotates. The developer thus conveyed comes into contact with the surface of the photoreceptor 2421.

The processor 2411 applies a developing bias to the developing sleeve 2423 to generate a potential for partially adhering the developer to the photosensitive surface according to the electrostatic latent image formed on the photosensitive surface. As a result, the electrostatic latent image on the photosensitive surface is made visible by the developer. Therefore, the photoreceptor 2421 is in a state of carrying the image formed by the developer, that is, the developer image on the photosensitive surface. That is, the photoreceptor 2421 is an example of an image carrier.

The processor 2411 applies a transfer bias to the transfer roller 2424. An electric field generated between the photosensitive surface and the transfer roller 2424 by this transfer bias transfers the developer image formed on the photosensitive surface to the belt 20 as an element image for one color.

A part of the developer adhering to the photosensitive surface remains on the photosensitive surface without being transferred to the belt 20. The developer remaining on the photosensitive surface in this way is scraped off by the cleaning blade 2425 and is stored in the storage container. Thus, the cleaning blade 2425 is an example of a cleaning member that removes the developer adhering to the surface of the image carrier by the frictional force.

In such a state, the developer remaining on the photosensitive surface without being transferred to the belt 20 may remain in the vicinity of the tip of the cleaning blade 2425 without being stored in the storage container and may stick. The developer has a property of being melted by heating in order to fix the developer on a print sheet. Therefore, when the temperature is high, the developer remaining on the tip of the cleaning blade 2425 is melted and thus tends to be more likely to stick.

When the MFP 100 is performing an operation for image formation, the processor 2411 in the formation controller 241 executes information processing for a well-known operation for image formation (hereinafter, referred to as formation control processing). Further, the processor 2411 executes information processing for controlling the reverse rotation operation (hereinafter referred to as reverse rotation control processing) according to the reverse rotation control program PRA, in parallel with the formation control processing every time the image formation on one print sheet under the formation control processing is completed.

Figure 5:
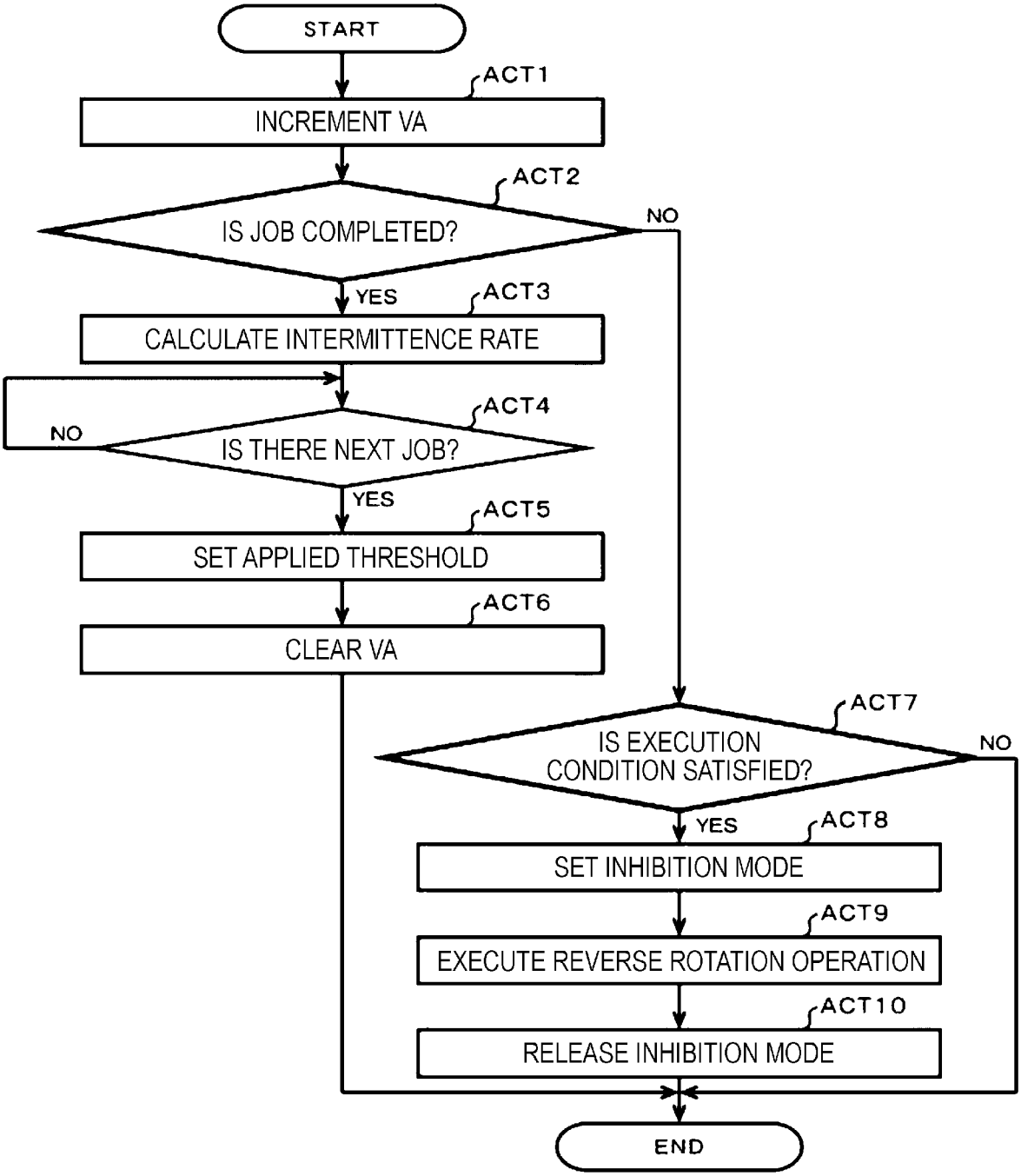
FIG. 5 is a flowchart of reverse rotation control processing.

FIG. 5 is a flowchart of the reverse rotation control processing in the first embodiment.

As ACT 1, the processor 2411 increments a variable VA. The variable VA is a count value of the number of sheets formed in one job. That is, the processor 2411 counts up the count value of the number of formed sheets in accordance with the image formation that was executed immediately before.

As ACT 2, the processor 2411 confirms whether or not the job being executed is completed by the completion of the immediately preceding image formation. Then, when the job is completed, the processor 2411 determines YES and proceeds to ACT 3.

As ACT 3, the processor 2411 calculates the intermittence rate in consideration of the number of formed sheets in the job completed this time. In the present embodiment, the processor 2411 calculates the average value of the number of sheets formed in the latest 10 jobs including the job completed this time. For this reason, the processor 2411 stores the value of the variable VA at the time of completion of at least the latest 10 jobs in the main memory 2412 or the sub memory 2413. This intermittence rate is one form of the image forming amount in a plurality of image forming jobs. Thus, the processor 2411 executes the information processing based on the reverse rotation control program. PRA, whereby the computer having the processor 2411 as a central part functions as a determination unit that determines the image forming amount.

As ACT 4, the processor 2411 confirms whether or not there is the next job. Then, when there is no other reserved job, the processor 2411 determines NO and repeats ACT 4. Thus, processor 2411 waits for the next job to occur when the next job is not reserved at the completion of one job. When there is the next job, the processor 2411 determines YES and proceeds to ACT 5.

As ACT 5, the processor 2411 sets a threshold (hereinafter referred to as an applied threshold) applied to the next job. The processor 2411 acquires, for example, the temperature measured by the temperature sensor 81 via the printer controller 7. Then, the processor 2411 reads out a threshold associated with the temperature zone into which the acquired temperature falls and the intermittence rate zone into which the intermittence rate calculated in ACT 3 falls in the threshold table TAA and sets the threshold as an applied threshold.

As ACT 6, the processor 2411 clears the variable VA in order to count the number of sheets formed in the next job to be started. Then, the processor 2411 ends the reverse rotation control processing.

When the job is not completed by the completion of the immediately preceding image formation, the processor 2411 determines NO in ACT 2 and proceeds to ACT 7.

As ACT 7, the processor 2411 confirms whether or not the condition for executing the reverse rotation operation is satisfied. The execution condition is predetermined as a condition that is satisfied when the number of sheets counted by the variable VA exceeds the reference number of sheets defined by the applied threshold. If the applied threshold is expressed as TH, the execution condition is defined as one of "VA>TH", "VA TH", and "VA=TH", for example. Which of these execution conditions is applied is appropriately set by, for example, the designer of the MFP 100. Then, when the execution condition is satisfied, the processor 2411 determines YES and proceeds to ACT 8.

As ACT 8, the processor 2411 sets an inhibition mode. During the setting of the inhibition mode, the processor 2411 inhibits the start of the operation for image formation by the formation control processing.

As ACT 9, the processor 2411 executes a reverse rotation operation. For example, the processor 2411 drives the rotation mechanism 2426 via the interface unit 2414 to rotate the photoreceptor 2421 in the direction DB. By the reverse rotation of the photoreceptor 2421, the developer adhering in the vicinity of the tip of the cleaning blade 2425 is separated from the cleaning blade 2425. The rotation amount of the photoreceptor 2421 at this time is a predetermined angle or rotation number. The rotation amount is determined to such an extent that the amount of the developer adhering in the vicinity of the tip of the cleaning blade 2425 can be made smaller than the specified amount. The rotation amount is appropriately set by, for example, the designer of the MFP 100 based on experiments, simulations, empirical rules, and the like. For example, the rotation amount is the extent to move about 10 to 15 mm.

As described above, the processor 2411 rotates the photoreceptor 2421 in the direction DA as a first direction during an image forming period, whereas the processor 2411 rotates the photoreceptor 2421 in the direction opposite to the direction DA at the reverse rotation timing when the execution condition is satisfied. Then, the processor 2411 changes the execution condition by changing the applied threshold according to the intermittence rate as the image forming amount. Thus, the processor 2411 executes information processing based on the reverse rotation control program PRA, whereby the computer having the processor 2411 as a central part functions as a first control unit.

As ACT 10, the processor 2411 releases the inhibition mode. In response to this, the processor 2411 starts the operation for the next image formation by the formation control processing.

When it is determined to be NO in ACT 7 because the execution condition is not satisfied, the processor 2411 ends the reverse rotation control processing without executing ACT 8 to ACT 10, that is, without executing the reverse rotation operation. In this case, the processor 2411 starts the next image formation, following the image formation that was just completed, by the formation control processing.

As described above, the MFP 100 can separate the developer adhering in the vicinity of the tip of the cleaning blade 2425 from the cleaning blade 2425 by the reverse rotation operation. As a result, the MFP 100 can prevent the developer from sticking to the cleaning blade 2425.

Moreover, the higher the intermittence rate, the smaller the threshold applied to the MFP 100. Therefore, the higher the intermittence rate, the more frequently the reverse rotation operation is performed. As the intermittence rate is higher, the temporal density is higher during the period in which the photoreceptor 2421 is rotated in the direction DA, and the developer and the like are likely to be accumulated in the vicinity of the tip of the cleaning blade 2425. However, in such a situation, in the MFP 100, the frequency of performing the reverse rotation operation increases, so that the developer can be prevented from sticking to the cleaning blade 2425. On the contrary, in the MFP 100, when the intermittence rate is low and it is difficult for the developer and the like to be accumulated in the vicinity of the tip of the cleaning blade 2425, the frequency of performing the reverse rotation operation can be suppressed to a low level, and thus the productivity can be maintained.

Further, when the intermittence rate is the same, the MFP 100 applies a smaller threshold as the temperature rises. Thus, the higher the temperature, the more frequently the reverse rotation operation is executed. As a result, when the sticking is likely to occur by the melting of the developer due to the temperature, the execution frequency of the reverse rotation operation is increased and thus the sticking of the developer to the cleaning blade 2425 can be prevented. On the contrary, when the temperature of the MFP 100 is low and the developer is not melted, the execution frequency of the reverse rotation operation can be suppressed to a low level, and thus the productivity can be maintained.

Second Embodiment

The MFP 100 according to a second embodiment may have the same hardware configuration as that of the first embodiment.

Figures 6, 7:
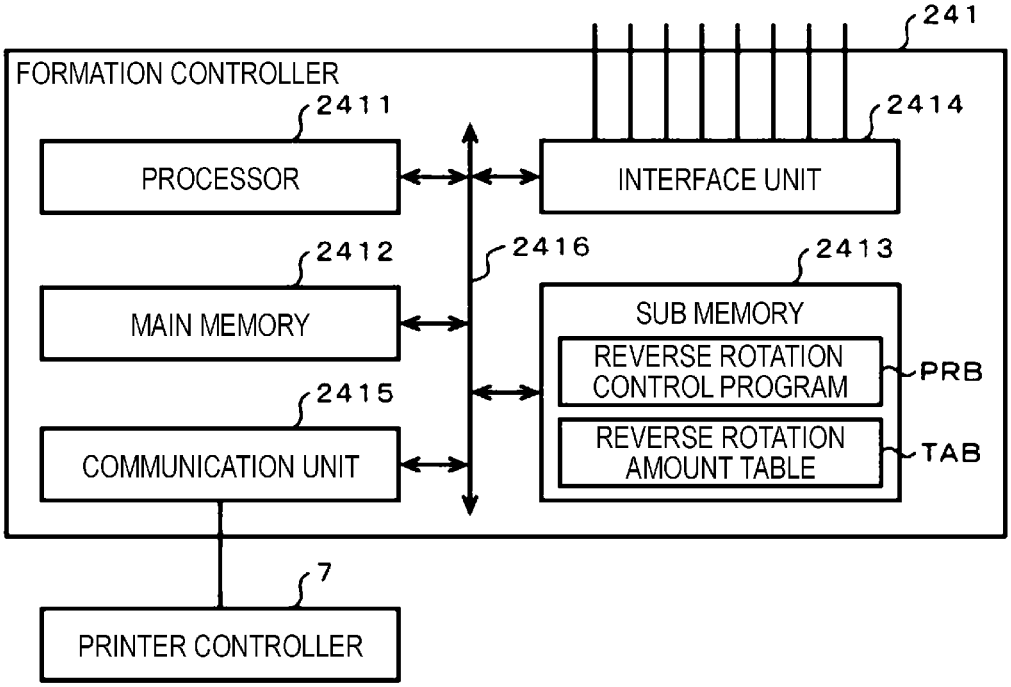
FIG. 6 is a diagram showing a circuit configuration of a main part of a formation controller in an MFP according to a second embodiment.
FIG. 7 is a diagram showing an example of a reverse rotation amount table TAB.

FIG. 6 is a diagram showing a circuit configuration of a main part of the formation controller 241 in the MFP 100 according to the second embodiment.

The MFP 100 according to the second embodiment is different from the first embodiment in that, as shown in FIG. 6, the sub memory 2413 of the formation controller 241 stores a reverse rotation control program. PRB and a reverse rotation amount table TAB instead of the reverse rotation control program PRA and the threshold table TAA.

FIG. 7 is a diagram showing an example of the reverse rotation amount table TAB.

The reverse rotation amount table TAB is a data table in which the rotation amount of the photoreceptor 2421 during the reverse rotation operation is described. In the present embodiment, the rotation amount is determined in association with each combination of the five temperature zones TZA, TZB, TZC, TZD, and TZE and the four intermittence rate zones IRA, IRB, IRC, and IRD. Each temperature zone and each intermittence rate zone are the same as in the first embodiment.

Each rotation amount has a relationship of QAA<QAB<QAC<QAD, QBA<QBB<QBC<QBD, QCA<QCB<QCC<QCD, QDA<QDB<QDC<QDD, and QEA<QEB<QEC<QED. That is, the rotation amount associated with the same temperature zone has a larger value as the associated intermittence rate zone is larger. Specifically, for example, the rotation amount QAA is set to "9 rotations" and the rotation amount QAB is set to "10 rotations".

Each threshold has a relationship of QAA>QBA>QCA>QDA>QEA, QAB>QBB>QCB>QDB>QEB, QAC>QBC>QCC>QDC>QEC, and QAD>QBD>QCD>QDD>QED. That is, the rotation value associated with the same intermittence rate zone has a larger value as the associated temperature zone is higher. Specifically, for example, the rotation amount QAA is set to "9 rotations" and the rotation amount QBA is set to "8 rotations".

The specific value of each rotation amount changes depending on the properties of the developer used. Therefore, the reverse rotation amount table TAB is appropriately set by, for example, the designer of the MFP 100 based on experiments, simulations, empirical rules, and the like.

Next, the reverse rotation control processing in the MFP 100 according to the second embodiment will be described.

In the MFP 100 according to the second embodiment, the processor 2411 executes the reverse rotation control processing according to the reverse rotation control program PRB, in parallel with the formation control processing every time the image formation on one print sheet under the formation control processing is completed.

Figure 8:
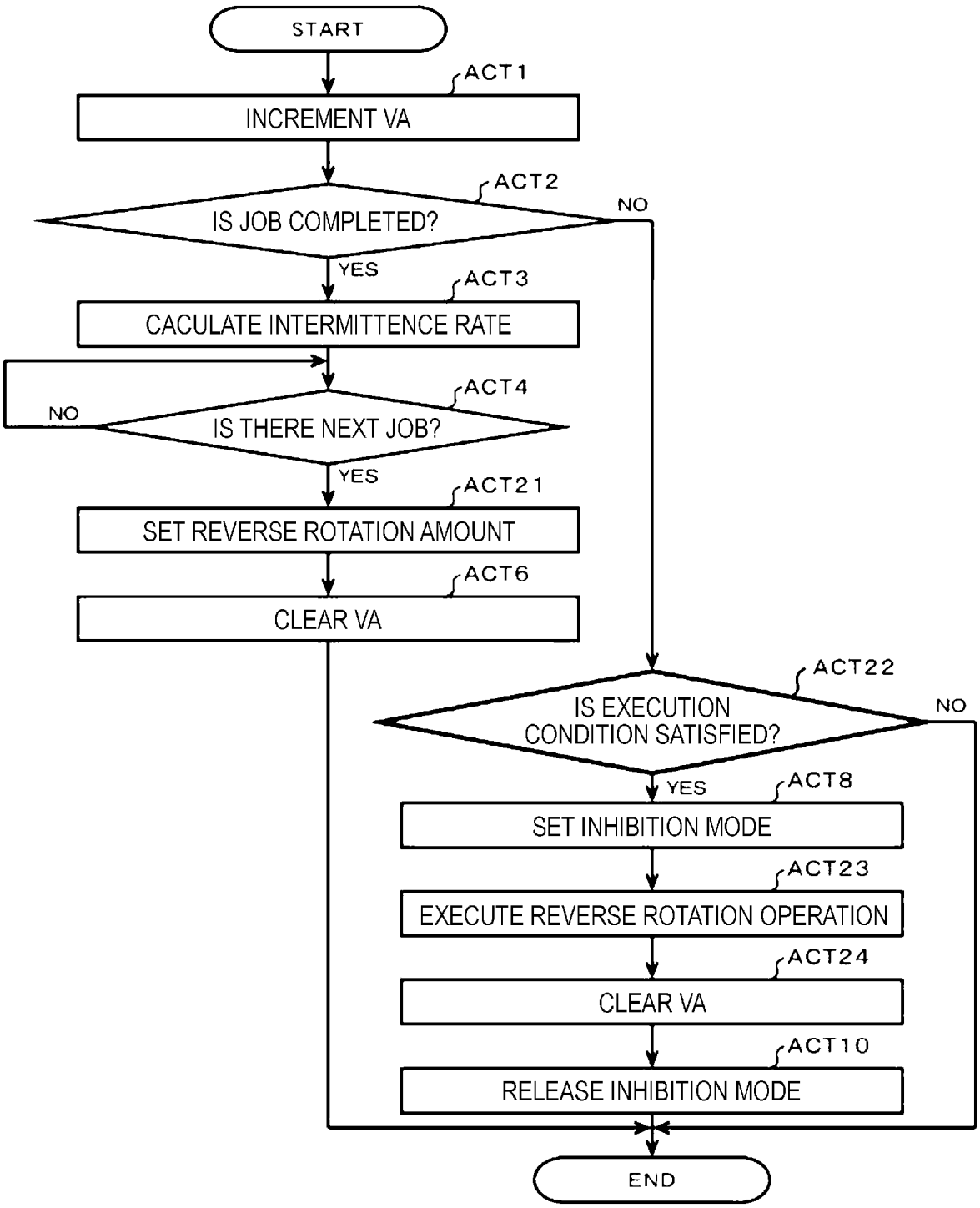
FIG. 8 is a flowchart of reverse rotation control processing in the second embodiment.

FIG. 8 is a flowchart of the reverse rotation control processing in the second embodiment. The same processes as those shown in FIG. 3 are denoted by the same reference numerals and the description thereof will be omitted.

The processor 2411 performs ACT 1 to ACT 4 in the same manner as in the first embodiment. When it is determined to be YES in ACT 4 because there is the next job, the processor 2411 proceeds to ACT 21.

As ACT 21, the processor 2411 sets the rotation amount (hereinafter referred to as the applied rotation amount) applied to the next job. The processor 2411 acquires, for example, the temperature measured by the temperature sensor 81 via the printer controller 7. Then, the processor 2411 reads the rotation amount associated with the temperature zone into which the acquired temperature falls and the intermittence rate zone into which the intermittence rate calculated in ACT 3 falls in the reverse rotation amount table TAB, and sets the rotation amount as the applied rotation amount.

Subsequently, the processor 2411 performs ACT 6 in the same manner as in the first embodiment and ends the reverse rotation control processing.

When it is determined to be NO in ACT 2 because the job is not completed by the completion of the immediately preceding image formation, the processor 2411 proceeds to ACT 22.

As ACT 22, the processor 2411 confirms whether or not the reverse rotation operation execution condition is satisfied. The execution condition is predetermined as a condition that is satisfied when the number of formed sheets counted by the variable VA exceeds the reference number of sheets which is fixed in advance. If the reference number of sheets is expressed as RN, the execution condition is defined as one of "VA>RN", "VA RN", and "VA=RN", for example. Which of the reference number of sheets or the execution conditions is applied is appropriately set by, for example, the designer of the MFP 100. Then, when the execution condition is satisfied, the processor 2411 determines YES and proceeds to ACT 8. Then, the processor 2411 performs ACT 8 in the same manner as in the first embodiment and then proceeds to ACT 23.

As ACT 23, the processor 2411 executes the reverse rotation operation. For example, the processor 2411 drives the rotation mechanism 2426 via the interface unit 2414 to rotate the photoreceptor 2421 in the direction DB. By the reverse rotation of the photoreceptor 2421, the developer adhering in the vicinity of the tip of the cleaning blade 2425 is separated from the cleaning blade 2425. The rotation amount of the photoreceptor 2421 at this time is the applied rotation amount.

As ACT 24, the processor 2411 clears the variable VA so that the number of formed sheets after the above reverse rotation can be counted.

Then, the processor 2411 performs ACT 10 in the same manner as in the first embodiment and then ends the reverse rotation control processing.

When it is determined to be NO in ACT 22 because the execution condition is not satisfied, the processor 2411 ends the reverse rotation control processing without executing ACT 8, ACT 23, ACT 24, and ACT 10, that is, without executing the reverse rotation operation.

As described above, the MFP 100 according to the second embodiment can also prevent the developer from sticking to the cleaning blade 2425 by the reverse rotation operation.

Moreover, in the MFP 100 according to the second embodiment, the higher the intermittence rate, the larger the rotation amount in the reverse rotation operation. Therefore, even if the developer or the like easily accumulates in the vicinity of the tip of the cleaning blade 2425, the developer can be prevented from sticking to the cleaning blade 2425. On the contrary, in the MFP 100 according to the second embodiment, when the intermittence rate is low and it is difficult for the developer or the like to accumulate in the vicinity of the tip of the cleaning blade 2425, the rotation amount in the reverse rotation operation is suppressed to a low level, so that the time required for the reverse rotation operation can be shortened and the productivity can be maintained.

Further, the MFP 100 according to the second embodiment increases the rotation amount in the reverse rotation operation as the temperature rises when the intermittence rate is the same. Therefore, it is possible to prevent the developer from sticking to the cleaning blade 2425 even when the sticking is likely to occur by the melting of the developer due to temperature. On the contrary, in the MFP 100 according to the second embodiment, when the temperature is low and the developer is not melted, the rotation amount in the reverse rotation operation can be suppressed to a low level, so that the time required for the reverse rotation operation can be shortened and the productivity can be maintained.

Third Embodiment

The MFP 100 according to a third embodiment may have the same hardware configuration as that of the first embodiment.

Figure 9:
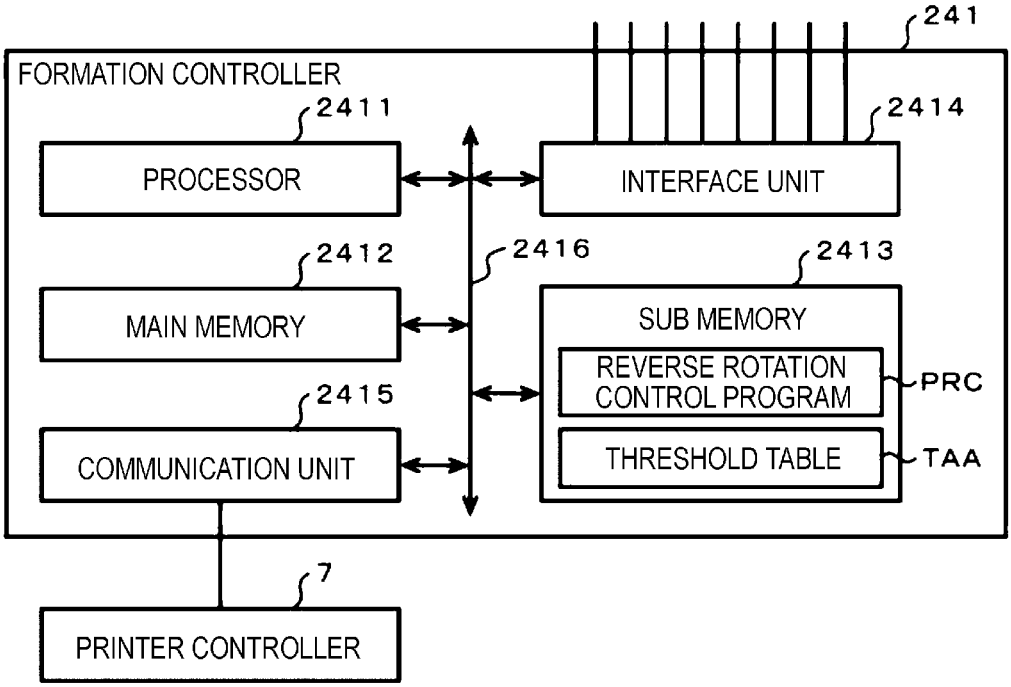
FIG. 9 is a diagram showing a circuit configuration of a main part of a formation controller in an MFP according to a third embodiment.

FIG. 9 is a diagram showing a circuit configuration of a main part of the formation controller 241 in the MFP 100 according to the third embodiment.

The MFP 100 according to the third embodiment is different from the first embodiment in that, as shown in FIG. 9, the sub memory 2413 of the formation controller 241 stores a reverse rotation control program PRC instead of the reverse rotation control program PRA.

Next, the reverse rotation control processing in the MFP 100 according to the third embodiment will be described.

In the MFP 100 according to the third embodiment, the processor 2411 executes the reverse rotation control processing according to the reverse rotation control program PRC, in parallel with the formation control processing every time the image formation on one print sheet under the formation control processing is completed.

Figure 10:
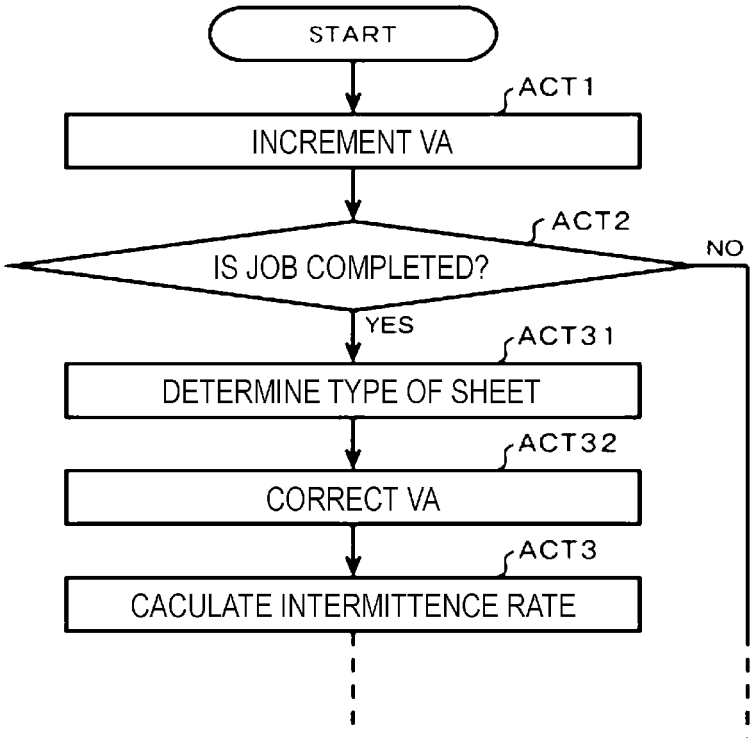
FIG. 10 is a flowchart of reverse rotation control processing in the third embodiment.

FIG. 10 is a flowchart of the reverse rotation control processing in the third embodiment. The same processes as those shown in FIG. 3 are denoted by the same reference numerals and the description thereof will be omitted. Further, since the processes after ACT 4 and after ACT 7 are the same as those of the first embodiment, the illustration thereof is also omitted.

The processor 2411 performs ACT 1 and ACT 2 in the same manner as in the first embodiment. When it is determined to be YES in ACT 2 because the job is completed, the processor 2411 proceeds to ACT 31.

As ACT 31, the processor 2411 determines the type of print sheet used in the immediately preceding job. For example, the processor 2411 inquires of the printer controller 7 about the type of print sheet used in the immediately preceding job and makes the above determination based on the content of the response thereto. The printer controller 7 manages the type of print sheet set in each of the sheet feed cassettes 10-1, 10-2, and 10-3 according to, for example, the setting made by the user. Then, the printer controller 7 notifies the formation controller 241 of the type of print sheet, for example, set in the sheet feed cassette selected in the immediately preceding job, as a response to the inquiry by the processor 2411. Then, the processor 2411 determines the type of print sheet used in the immediately preceding job based on the above notification.

As ACT 32, the processor 2411 corrects the variable VA according to the type of print sheet used in the immediately preceding job. Specifically, the processor 2411 corrects the variable VA so as to represent the image forming amount in consideration of the difference in the magnitude of the influence depending on the type of print sheet.

Meanwhile, when the support roller 23 and the transfer roller 26 sandwich the belt 20 together with the print sheet, paper dust adheres to the belt 20 from the print sheet. Then, the paper dust adhering to the belt 20 further adheres to the photosensitive surface of the photoreceptor 2421. The paper dust adhering to the photosensitive surface is scraped off by the cleaning blade 2425 but part of the paper dust is accumulated in the vicinity of the tip of the cleaning blade 2425. The substances that adhere to the belt 20 from the print sheet may include substances other than paper dust but since most of the substances are paper dust, the substances that adhere to the belt 20 from the print sheet are referred to as "paper dust" here.

The amount of paper dust generated varies depending on the type of print sheet. Therefore, the amount of paper dust accumulated in the vicinity of the tip of the cleaning blade 2425, that is, the degree of influence on the cleaning ability of the cleaning blade 2425 also varies depending on the type of print sheet. Therefore, the processor 2411 corrects the variable VA to have a value that reflects the difference in the degree of influence in ACT 32. For example, the processor 2411 multiplies the variable VA by a coefficient determined in advance for each type of print sheet. The coefficient in this case is appropriately set by, for example, the designer of the MFP 100 based on experiments, simulations, empirical rules, and the like so that the coefficient has a value according to the difference in the above degree of influence.

After that, the processor 2411 executes ACT 3 and subsequent processes in the same manner as in the first embodiment.

The processor 2411 performs ACT 3 in the same manner as in the first embodiment, but the variable VA is corrected as described above, and thus the calculated intermittence rate is obtained as a value in consideration of the above degree of influence. As a result, the confirmation in ACT 7 is also made as a determination in consideration of the above degree of influence.

Thus, the MFP 100 according to the third embodiment can achieve the same effect as that of the first embodiment. Then, according to the MFP 100 according to the third embodiment, the execution timing of the reverse rotation operation can be further optimized in consideration of the degree of influence of the paper dust generated from the print sheet used in the executed job.

Fourth Embodiment

The MFP 100 according to a fourth embodiment may have the same hardware configuration as that of the first embodiment.

Figure 11:
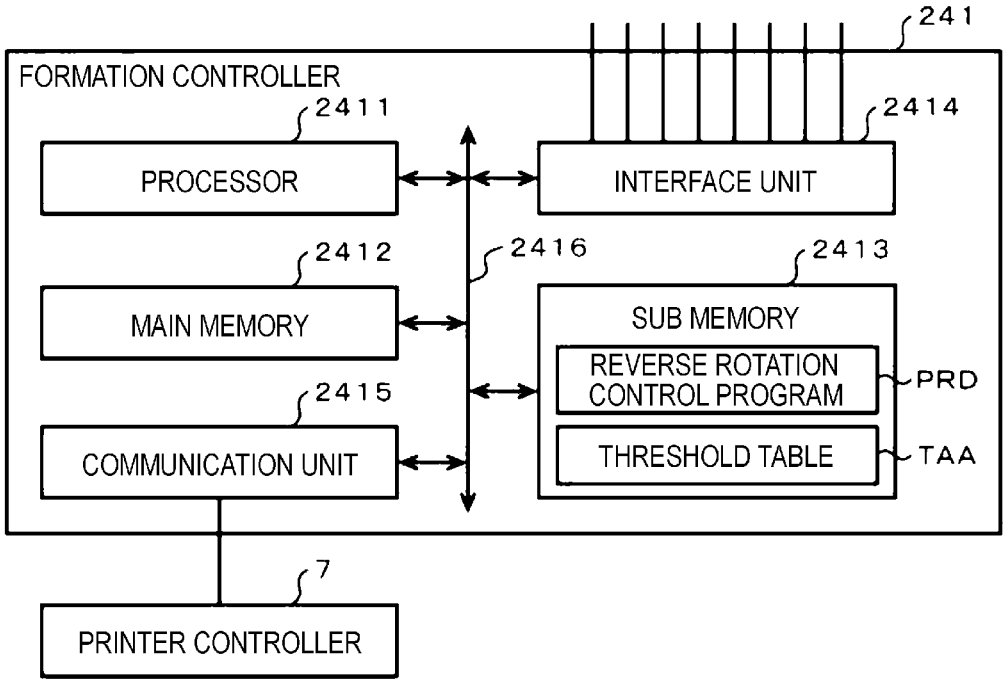
FIG. 11 is a diagram showing a circuit configuration of a main part of a formation controller in an MFP according to a fourth embodiment.

FIG. 11 is a diagram showing a circuit configuration of a main part of the formation controller 241 in the MFP 100 according to the fourth embodiment.

The MFP 100 according to the fourth embodiment is different from the first embodiment in that, as shown in FIG. 11, the sub memory 2413 of the formation controller 241 stores a reverse rotation control program PRD instead of the reverse rotation control program PRA.

Next, the reverse rotation control processing in the MFP 100 according to the fourth embodiment will be described.

In the MFP 100 according to the fourth embodiment, the processor 2411 executes the reverse rotation control processing according to the reverse rotation control program PRD, in parallel with the formation control processing every time the image formation on one print sheet under the formation control processing is completed.

Figure 12:
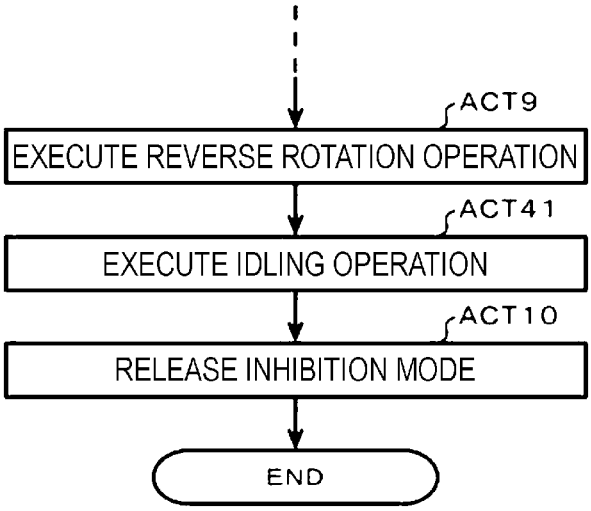
FIG. 12 is a flowchart of reverse rotation control processing in the fourth embodiment.

FIG. 12 is a flowchart of the reverse rotation control processing in the fourth embodiment. The same processes as those shown in FIG. 3 are denoted by the same reference numerals and the descriptions thereof will be omitted. Further, since each process up to ACT 8 is the same as that of the first embodiment, the illustration thereof is also omitted.

When the reverse rotation operation in ACT 9 is completed, the processor 2411 proceeds to ACT 41.

As ACT 41, the processor 2411 executes an idling operation. The idling operation is an operation of rotating the photoreceptor 2421 in the direction DA without performing image formation. For example, the processor 2411 supplies charging power and a developing bias for forming a charging potential and a developing potential, which are in the relationship of causing a small amount of fog on the photosensitive surface of the photoreceptor 2421, from the power supply unit 2427 to the charger 2422 and the developing sleeve 2423. Then, under such a potential condition, the processor 2411 drives the rotation mechanism 2426 via the interface unit 2414 to rotate the photoreceptor 2421 in the direction DA.

The rotation amount of the photoreceptor 2421 during the idling is appropriately set by, for example, the designer of the MFP 100 based on experiments, simulations, empirical rules, and the like. The rotation amount is, for example, about 100 to 150 rotations. However, in the above idling state, there is a risk that the cleaning blade 2425 may turn over. When a diameter of the photoreceptor 2421 is 30 mm and a peripheral velocity when idling is 225 mm/s, the photoreceptor 2421 rotates 2.38 times per second. In this case, the rotation time of the photoreceptor 2421 is preferably 40 to 60 seconds. As an example, it is preferable to set the difference between the charging power and the developing bias, that is, a background potential to 110±20 V. When the background potential becomes smaller than the above range, the ground fog becomes too large. When the background potential is higher than the above range, the adhering amount of carrier in the developer becomes too large.

The substance adhering to the tip of the cleaning blade 2425 can be separated from the cleaning blade 2425 even by such an idling operation. Then, during this idling operation, a small amount of toner adhering to the photosensitive surface due to fog remains between the photosensitive surface and the tip of the cleaning blade 2425. As a result, it is possible to prevent excessive friction between the photosensitive surface and the cleaning blade 2425 during the idling operation. Further, at the end of the idling operation, there is no excessive friction between the photosensitive surface and the cleaning blade 2425 as described above, and thus when the image formation is subsequently started, the positional relationship between the photosensitive surface and the tip of the cleaning blade 2425 is stable, and the photosensitive surface can be stably cleaned in the subsequent image formation. The amount of rotation of the photoreceptor 2421, the charging power, and the developing bias in the idling operation are appropriately set by, for example, the designer of the MFP 100 based on experiments, simulations, empirical rules, and the like.

By controlling the idling operation as described above, the processor 2411 executes information processing based on the reverse rotation control program PRD, whereby the computer having the processor 2411 as a central part functions as a second control unit.

After finishing the idling operation, the processor 2411 proceeds to ACT 10.

Thus, the MFP 100 according to the fourth embodiment can achieve the same effect as that of the first. Then, according to the MFP 100 according to the fourth embodiment, even if most of the developer between the photoreceptor 2421 and the tip of the cleaning blade 2425 is removed by the reverse rotation operation, a state in which the photosensitive surface can be stably cleaned as described above is formed by the idling operation before the next image forming operation is started. As a result, it is possible to favorably perform image formation after performing the reverse rotation operation.

Each of the above embodiments can be modified in various ways as follows.

An image forming apparatus including one to three or five or more developing devices can be implemented in the same manner as the above embodiments.

In each of the above embodiments, the change in the threshold according to the intermittence rate is set to four stages, but any number of stages of two or more may be used. Here, in the first embodiment, a larger intermittence rate is associated with a smaller threshold. Further, in the second embodiment, a larger intermittence rate is associated with a larger reverse rotation amount.

In each of the above embodiments, five temperature zones are set. However, two or more temperature zones may be optionally set. Here, in the first embodiment, a higher temperature is associated with a smaller threshold at the same number of times of execution. Further, in the second embodiment, a higher temperature is associated with a larger reverse rotation amount at the same number of times of execution.

In each of the above embodiments, the threshold or the reverse rotation amount may be set in association with the intermittence rate without considering the temperature.

In each of the above embodiments, the image forming amount may be determined by correcting the number of formed sheets in consideration of the size of the print sheet used for each job.

The number of formed sheets used to calculate the intermittence rate is not necessarily for continuous jobs. For example, the intermittence rate may be calculated as the average value of the number of formed sheets for 10 jobs selected according to a predetermined rule from 15 continuous jobs. Even when the intermittence rate is calculated with respect to the intermittence rate for a plurality of continuous jobs, the corresponding job may not include the latest job or some jobs from the latest.

In each of the above embodiments, the image forming amount may be determined as an amount different from the intermittence rate, such as the total number of sheets formed in a plurality of predetermined jobs, the total execution time or the average execution time of the image forming operation in the plurality of predetermined jobs, or the total rotation number or the average rotation number of the photoreceptor 2421 in the plurality of predetermined jobs. That is, the image forming amount may be a value that represents the degree of influence of the executed job on the accumulation of the substance such as the developer or the paper dust in the vicinity of the tip of the cleaning blade 2425.

Generally, the MFP has a function of counting the total number of sheets of executed image formation. Therefore, in each of the above embodiments, the processor 2411 may determine the number of sheets to be formed in one job using the count value obtained by such a function. For example, the processor 2411 stores the total number of sheets at the completion of the previous job in the main memory 2412 or the sub memory 2413. Then, the processor 2411 may obtain the number of sheets to be formed in the new job by subtracting the total number of sheets stored as described above from the total number of sheets when the new job is completed.

The MFP may have a function of counting the number of sheets formed in one job. Therefore, in each of the above embodiments, the processor 2411 may use the number of formed sheets counted by such a function and may not perform the counting using the variable VA.

In each of the above embodiments, the processor 2411 may execute the formation control processing and the reverse rotation control processing as integrated information processing based on a single information processing program.

In each of the above embodiments, the processor 2411 may acquire the threshold or the reverse rotation amount by another method such as a calculation based on a predetermined mathematical expression.

In each of the above embodiments, a pressing force of the cleaning blade 2425 against the photosensitive surface of the photoreceptor 2421 may be adjusted when the photoreceptor 2421 is rotated in the reverse direction. For example, by increasing the pressing force at the time of reverse rotation with respect to the pressing force at the time of image formation, it is possible to promote the removal of the substance from the vicinity of the tip of the cleaning blade 2425.

Some or all of the functions realized by the processor 2411 by information processing in each of the above-described embodiments can be realized by hardware that executes information processing that is not based on a program, such as a logic circuit. Further, each of the above-mentioned respective functions can be realized by combining hardware such as the above logic circuit with software control.

The changes in the third embodiment from the first embodiment can also be applied to the second embodiment. That is, FIG. 8 may be changed as shown in FIG. 10 and ACT 31 and ACT 32 may be executed in the same manner as above.

The changes in the fourth embodiment from the first embodiment can also be applied to the second embodiment. That is, FIG. 8 may be changed as shown in FIG. 12 and ACT 41 may be executed in the same manner as above.

The changes in the fourth embodiment from the first embodiment can also be applied to the third embodiment. That is, FIG. 8 may be changed as shown in FIG. 10 and FIG. 12 and ACT 31, ACT 32, and ACT 41 may be executed in the same manner as above.

In the fourth embodiment, the pressing force of the cleaning blade 2425 against the photosensitive surface of the photoreceptor 2421 may be adjusted when the photoreceptor 2421 idles. For example, the cleaning performance of the tip of the cleaning blade 2425 can be improved by increasing the pressing force during the reverse rotation with respect to the pressing force during image formation.

While certain embodiments have been described, these embodiments have been presented by way of example only, and are not intended to limit the scope of invention. Indeed, the novel apparatus and methods described herein may be embodied in a variety of other forms; furthermore, various omissions, substitutions and changes in the form of the apparatus and methods described herein may be made without departing from the spirit of the inventions. The accompanying claims and their equivalents are intended to cover such forms or modifications as would fall within the scope and spirit of the inventions.

What is claimed is:

1. An image forming apparatus, comprising:

an image carrier configured to carry a developer image;

a cleaning member configured to remove a developer adhering to a surface of the image carrier by a frictional force when the image carrier is rotated in a first direction;

a determination component configured to determine an image forming amount in a plurality of continuous image forming jobs, wherein the image forming amount is calculated based on the number of the plurality of continuous image forming jobs and the number of sheets on which images are formed by the image forming job, and wherein the image forming amount is defined as a ratio of the number of sheets on which images are formed by the image forming job to the number of the plurality of continuous image forming jobs; and a controller configured to:

rotate the image carrier in the first direction during an image forming period and in a second direction opposite to the first direction at reverse rotation timing, and change a condition for rotation in the second direction according to a determination result.

2. The image forming apparatus according to claim 1, wherein when the image forming amount is larger than a predetermined value, the controller rotates the image carrier in the second direction more frequently than when the image forming amount is equal to or smaller than the predetermined value.

3. The image forming apparatus according to claim 1, wherein when the image forming amount is larger than a predetermined value, the controller increases an amount of rotating the image carrier in the second direction more than when the image forming amount is equal to or smaller than the predetermined value.

4. The image forming apparatus according to claim 1, further comprising:

a temperature sensor configured to detect a temperature in the image forming apparatus, wherein the controller sets, as the reverse rotation timing, timing which is determined according to the image forming amount after rotating the image carrier in the second direction, and the determination result.

5. The image forming apparatus according to claim 1, further comprising:

a temperature sensor configured to detect a temperature in the image forming apparatus, wherein the controller sets the rotation amount in the second direction to a rotation amount determined in advance according to the determination result and the temperature detected by the temperature sensor.

6. The image forming apparatus according to claim 1, wherein after the rotation in the second direction, the controller rotates the image carrier in the first direction in a state where the developer adheres to the image carrier separately from the image formation.

7. A control method of an image forming apparatus including an image carrier configured to carry a developer image, and a cleaning member configured to remove a developer adhering to a surface of the image carrier by a frictional force when the image carrier is rotated in a first direction, the control method comprising:

determining an image forming amount in a plurality of continuous image forming jobs, wherein the image forming amount is calculated based on the number of the plurality of continuous image forming jobs and the number of sheets on which images are formed by the image forming job, and wherein the image forming amount is defined as a ratio of the number of sheets on which images are formed by the image forming job to the number of the plurality of continuous image forming jobs, controlling the image carrier to rotate in the first direction during an image forming period and in a second direction opposite to the first direction at reverse rotation timing, and changing a condition for rotation in the second direction according to a determination result in the determining of the image forming amount.

8. The method according to claim 7, further comprising:

when the image forming amount is larger than a predetermined value, rotating the image carrier in the second direction more frequently than when the image forming amount is equal to or smaller than the predetermined value.

9. The method according to claim 7, further comprising:

when the image forming amount is larger than a predetermined value, increasing an amount of rotating the image carrier in the second direction more than when the image forming amount is equal to or smaller than the predetermined value.

10. The method according to claim 7, further comprising:

detecting a temperature in the image forming apparatus; and setting, as the reverse rotation timing, timing which is determined according to:

the image forming amount after rotating the image carrier in the second direction, and the determination result.

11. The method according to claim 7, further comprising:

detecting a temperature in the image forming apparatus; and setting the rotation amount in the second direction to a rotation amount determined in advance according to the determination result and the temperature detected.

12. The method according to claim 7, further comprising:

after the rotation in the second direction, rotating the image carrier in the first direction in a state where the developer adheres to the image carrier separately from the image formation.

13. A cleaning system for an image forming apparatus, comprising:

a cleaning member configured to remove a developer adhering to a surface of an image carrier by a frictional force when the image carrier is rotated in a first direction;

a determination component configured to determine an image forming amount in a plurality of continuous image forming jobs, wherein the image forming amount is calculated based on the number of the plurality of continuous image forming jobs and the number of sheets on which images are formed by the image forming job, and wherein the image forming amount is defined as a ratio of the number of sheets on which images are formed by the image forming job to the number of the plurality of continuous image forming jobs; and a controller configured to:

rotate the image carrier in the first direction during an image forming period and in a second direction opposite to the first direction at reverse rotation timing, and change a condition for rotation in the second direction according to a determination result.

14. The cleaning system according to claim 13, wherein when the image forming amount is larger than a predetermined value, the controller rotates the image carrier in the second direction more frequently than when the image forming amount is equal to or smaller than the predetermined value.

* * * * *